US009890544B2

(12) United States Patent
Fenerci

(10) Patent No.: US 9,890,544 B2
(45) Date of Patent: Feb. 13, 2018

(54) SCAFFOLD WITH AN AUTOMATIC INSTALLATION CHARACTERISTIC

(71) Applicant: Abdurrahman Murat Fenerci, Bursa (TR)

(72) Inventor: Abdurrahman Murat Fenerci, Bursa (TR)

( * ) Notice: Subject to any disclaimer, the term of this patent is extended or adjusted under 35 U.S.C. 154(b) by 281 days.

(21) Appl. No.: 14/376,803

(22) PCT Filed: Jan. 16, 2013

(86) PCT No.: PCT/TR2013/000004
§ 371 (c)(1),
(2) Date: Aug. 5, 2014

(87) PCT Pub. No.: WO2013/119189
PCT Pub. Date: Aug. 15, 2013

(65) Prior Publication Data

US 2015/0060203 A1 Mar. 5, 2015

(30) Foreign Application Priority Data

Feb. 6, 2012 (TR) ..... 2012/01326

(51) Int. Cl.
*E04G 1/17* (2006.01)
*E04G 1/34* (2006.01)
(Continued)

(52) U.S. Cl.
CPC ..... *E04G 1/17* (2013.01); *E04G 1/34* (2013.01); *E04G 5/007* (2013.01); *E04G 2001/157* (2013.01)

(58) Field of Classification Search
CPC .. E04G 1/17; E04G 1/34; E04G 5/007; E04G 2001/157; E04G 1/18
See application file for complete search history.

(56) References Cited

U.S. PATENT DOCUMENTS 2,796,299 A 6/1957 Freeman
3,608,669 A * 9/1971 Lindsay, Jr. ..... E01D 19/106 182/14
(Continued)

FOREIGN PATENT DOCUMENTS

| | | |
|---|---|---|
| EP | 0142963 A2 | 5/1985 |
| GB | 2323623 A | 9/1998 |
| WO | 9527836 A1 | 10/1995 |

OTHER PUBLICATIONS

International Search Report for corresponding International Application No. PCT/TR2013/000004.

*Primary Examiner* — Katherine W Mitchell
*Assistant Examiner* — Marcus Menezes
(74) *Attorney, Agent, or Firm* — Egbert Law Offices, PLLC

(57) ABSTRACT

An automatic scaffold for reaching buildings during construction, repair, dyeing, coating, and maintenance. The automatic scaffold includes a scaffold module which has a stack of module layers. Movable columns open the scaffold modules by a drive unit so as to generate a distance between the module layers, wherein the distance is approximately of 2-meter height in which one person can comfortably work, and wherein the movable columns are respectively an outer carrier column which carries the scaffold module upwardly with the movement generated by the drive unit, and an inner movable column which is located inside the outer carrier column and linked to the outer carrier column via a control rod of the drive unit. Each module layer has vertical and horizontal rods, a carrier plate, and guide elements for fixing the vertical rods to the carrier plate.

13 Claims, 7 Drawing Sheets

(51) Int. Cl.
*E04G 5/00* (2006.01)
*E04G 1/15* (2006.01)

(56) References Cited

U.S. PATENT DOCUMENTS

| | | | | |
|---|---|---|---|---|
| 3,871,478 | A | 3/1975 | Bushnell, Jr. | |
| 4,275,797 | A * | 6/1981 | Johnson | E04G 1/24 180/13 |
| 4,452,337 | A * | 6/1984 | Atzinger | E04G 5/00 182/121 |
| 2004/0168854 | A1 * | 9/2004 | Azran | E04F 21/12 182/141 |

* cited by examiner

SCAFFOLD WITH AN AUTOMATIC INSTALLATION CHARACTERISTIC

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a scaffold which can be automatically installed for reaching buildings during construction, repair, dyeing, coating, and maintenance.

2. Description of Related Art Including Information Disclosed Under 37 CFR 1.97 and 37 CFR 1.98

In the currently used scaffold configurations, an embodiment is mentioned which has carrier plates on which bedding elements have been created, and intermediate contact rods which are connected with the bedding elements and provide folding movement by means of the bedding elements of the carrier plate. In this configuration, the scaffold opens/closes with a shearing equipment through the intermediate contact rods, and thereby the scaffold rises up.

In the patent search carried out in relation with the scaffolds, an application originating from Germany has been encountered with the application number EP07001953.4. In this application, a method of producing a scaffold is mentioned in which a wall is produced, wherein the wall protects the last filling with rod-shaped anchorages having a back anchorage plate, and wherein the anchorage rods are connected to the back surface of the wall, wherein the soil is filled as layers, and after a layer has been created, a set of horizontal anchorage rods are arranged under the water on the layer with a certain distance to each other, anchorage plates are connected to the ends of the anchorage rods, the wall connection locations that the anchorage has been connected at the back are planned, and then at least one additional soil layer is located on the bottom layer.

Another application is TR1999/00311 numbered application. In this application, the arrangement comprised of transporting units is equipped with a connection unit comprising a wedge-shaped conjunction head having a horizontal split to be put onto the porous ring fitted on the rod. For the wedge that can be inserted through the conjunction head and the porous ring, there are wedge-shaped holes. The conjunction head made of malleable casting production material comprises a housing part and a conjunction part. In order for the housing part to be fitted to the rod, it has housing wall parts with housing locations.

In another Turkish application with the number TR 2008/05306, on the other hand, a scaffold system is mentioned which is developed to be used on the building surfaces and in the constructions. The scaffold system according to that invention has a scaffold-carrier, a scaffold made of a space frame system by means of the equipment of the carrier, a scaffold drive unit, other parts thereof, brake-damper pulley systems, damper pulley systems and rope.

In another Turkish application numbered TR2006/01339; a wedged scaffold connection system is mentioned, which can be installed easily, allowing more than one horizontal pipe to be connected diagonally, produced for the installation of the scaffold systems in the processes like the outer siding construction, inner and outer siding paintings, painting and insulation, curtain-wall, sheep-construction and maintenance, tunnel-, dam-, bridge-, curtain construction and maintenance, shelf-making on the constructions for tribune and storage purposes; and has a vertical pipe, a horizontal pipe, a dovetail, a wedge, a flange (center) and diagonal elements in necessary conditions.

The currently used scaffold systems require a serious time period and effort for the installation and the removal processes of the scaffold as they do not have an automatic structure. As this is the case, the production processes and the costs are negatively affected.

BRIEF SUMMARY OF THE INVENTION

The purpose of the present invention, different than the scaffold configurations used in the current art, is to provide the scaffold to automatically rise up and to automatically go down.

A purpose of the invention is to perform the installation process of the scaffold in a very short time by means of a control unit or a remote control.

A purpose of the invention is to provide the scaffold to be easily installed without much effort. It is especially aimed to eliminate the work losses experienced during the installation of the scaffolds through the present system.

Another purpose of the present invention is to provide the materials and elements used during the construction of the scaffold with high strength and high resistance. Therefore it is aimed to provide work security and protection.

Another purpose of the present invention is to perform the desired width and height measurement and settings depending on the width and height of the construction. Therefore it is aimed to transfer the materials in accordance with the need without transferring unnecessary amount of materials and elements to the location where the scaffold will be installed.

A further purpose of the present invention is to decrease the period, cost, labour-force and mounting periods of the scaffold installations to a minimum level. It is aimed to positively affect the production processes with its fast, secure and easy installation.

Walking path platforms on the skeleton scaffold are optionally formed on the vertical and horizontal directions in the current scaffold systems, depending on the need and desire (No platform is added to the scaffold if desired), thus 50%-filled or wholly-filled platforms can be installed. However in the system according to the present invention, without locating the platform with complete width and length on the floor, the next floor cannot be constructed on it. When considering the reverse situation, in the present scaffold systems, all the desired platforms on the installed scaffold must be removed, and the scaffold must be installed with missing platforms. In the system according to the present invention, none of the walking path platforms on any intermediate floor can be removed, and in order to remove that platform, the system should be uninstalled totally from top to down.

In order to achieve the purposes mentioned above, the scaffold module has module layers put onto each other, movable columns which can be driven by a drive unit so as to open a distance (A) between the module layers for working, vertical and horizontal rods located between the module layers within the distance (A) and guide shafts located on the carrier plates which fix the vertical carrier rods.

PART NUMBERS

Figure 1:
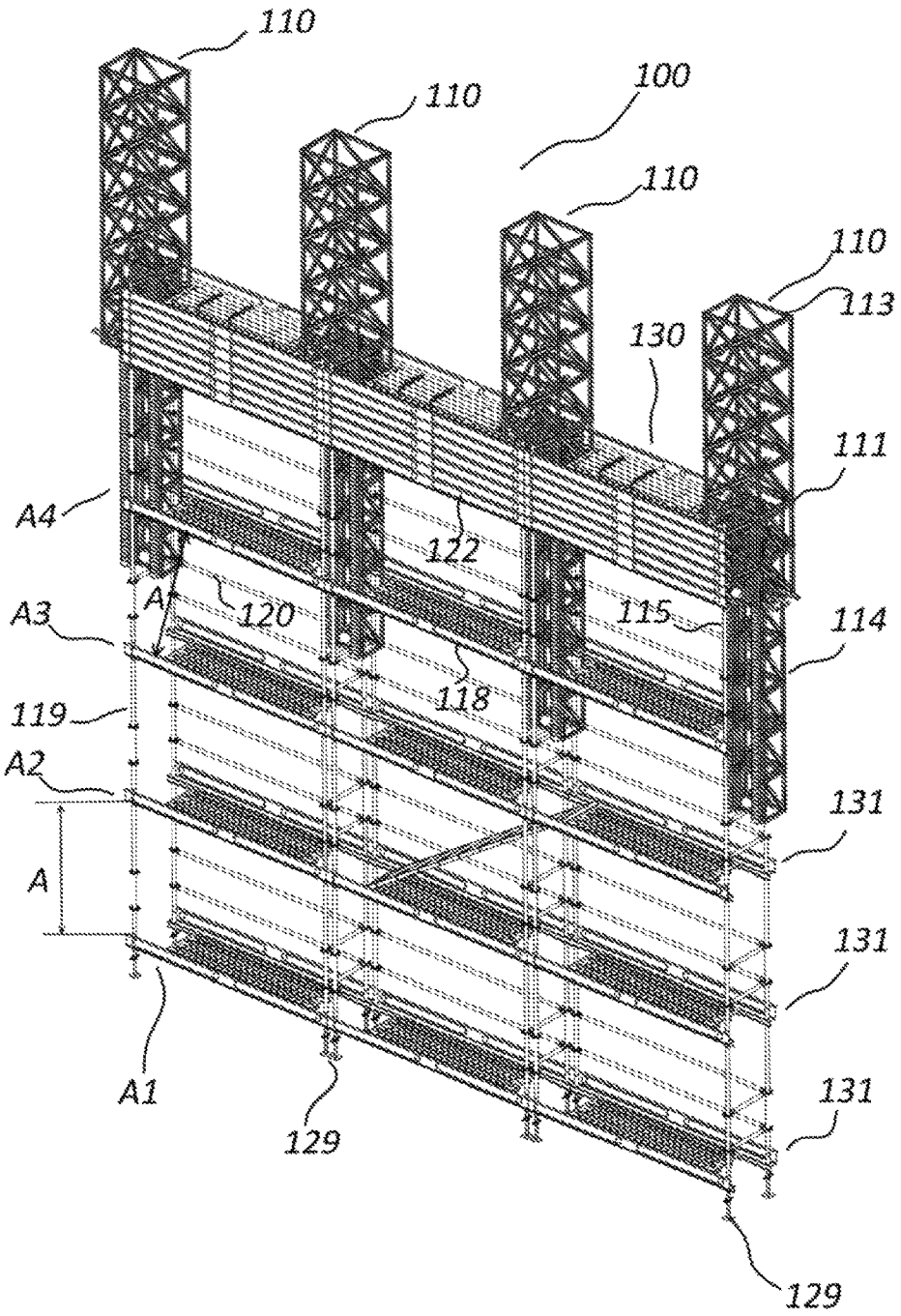
FIG. 1 is a perspective front view of the automatically installable scaffold according to the present invention.

100—Automatic scaffold
110—Movable column
111—Outer carrier column
112—Centering element
113—space Space
114—Inner movable column
115—Control rod
116—Drive unit
117—Circular gear
118—Carrier plate
119—Vertical carrier rod
120—Horizontal rod
121—Horizontal rod
122—Front cover
123—Ladder
124—Rod locating element
125—Guide element
126—Guide step section
127—Roller
128—Guide space
129—Leg
130—Scaffold module
131—Module layer
132—Remote control
A—Distance

DETAILED DESCRIPTION OF THE INVENTION

The automatic scaffold (100) of the present invention is suitable for reaching a building during construction, repair, dyeing, coating, and maintenance. The automatic scaffold (100) has a scaffold module (130) which includes module layers (131) that are superimposed, movable columns (110) which can be driven through a drive unit (116) so as to open a distance (A) between the module layers (131) for working, vertical and horizontal rods (119, 120) which are located between the module layers (131) within the distance (A), and guide elements (125) which are located on the carrier plates (118) for fixing the vertical carrier rods (119) thereto.

The outer carrier columns (111) carry the scaffold modules (130) which are connected thereto upwards in the s-direction with the movement generated through the drive unit (116). The drive unit (116) is a motor. Alternatively, the drive unit (116) is a piston with a hydraulic or a pneumatic system.

The automatic scaffold (100) has a circular gear (117) which is set into rotational movement through the drive unit (116), and a control rod (115) which is connected to the circular gear (117), an inner movable column (114) onto which the control rod (115) is fixed and which is located inside a space (113) of the outer carrier column (111), centering elements (112) which have rollers (127) for the linear movement of the inner movable column (114) inside the outer carrier column (111), guide step sections (126) respectively formed on the guide elements (125), guide spaces (128) formed on the carrier plate (118) so that the guide elements (125) can be located thereinto, rod locating elements (124) for locating in a fixed manner the vertical, horizontal rods (119, 120, 121) onto the carrier plate (118), front covers (122) fixed on the module layers (131) of the scaffold module (130), and legs (129) located at the bottom of the vertical carrier rods (119) and fixed onto the floor.

The working system of the automatic scaffold (100) is as follows. The system which is adjustable to the width measurements of the construction or building and which has multiple movable columns (110) can be carried either as a whole on a long vehicle or in parts thanks to its modular structure.

Figure 5:
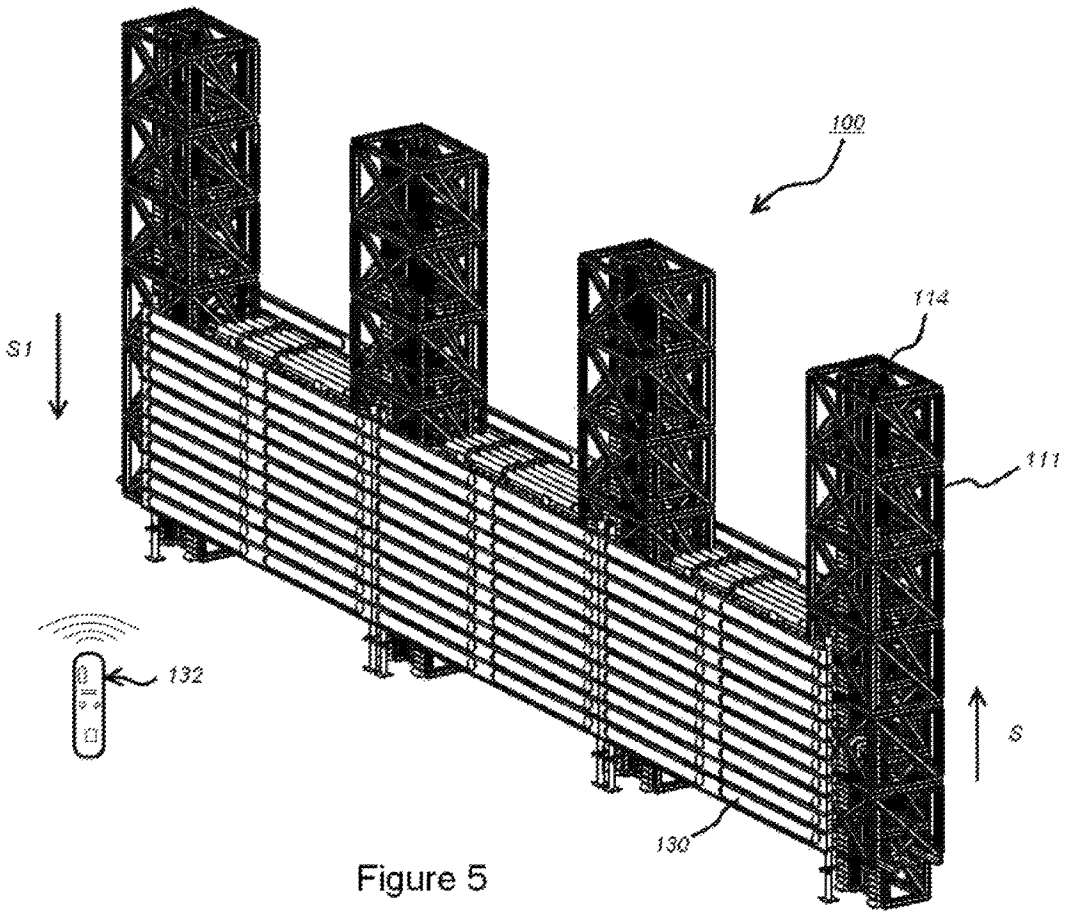
FIG. 5 is a general perspective view of the automatically installable scaffold when it is closed according to the present invention.

In FIG. 5, a scaffold module (130) is shown which includes preferably 11 module layers (131) on preferably 4 movable columns (110). FIG. 5 shows an uninstalled view of the scaffold (100). In order to start the installation process automatically, the system can be directed through a control unit or a remote control (132). Each scaffold module (130) is carried upwards in the s-direction as a whole in a way that one module layer (131) stays at the bottom. After the module layer (131) denoted with A1 at the bottom has been left, the other scaffold modules (130) are carried completely in the s-direction in a way that the distance (A) is formed. The distance (A) is approximately of 2-meter height, in which one person can comfortably work. After the distance (A) has been formed, another module layer (131) denoted with A2 is left free, and all the other module layers (131) are lifted upwards. Later on, again another module layer (131) denoted with A3 is left free, thus the module layers (131) of the scaffold modules (130) are separated, and intermediate distances (A) are formed (See FIG. 1).

It is the movable columns (110) which provides for the scaffold modules (130) to be carried and left in the s/s1 direction as a whole.

Figure 6:
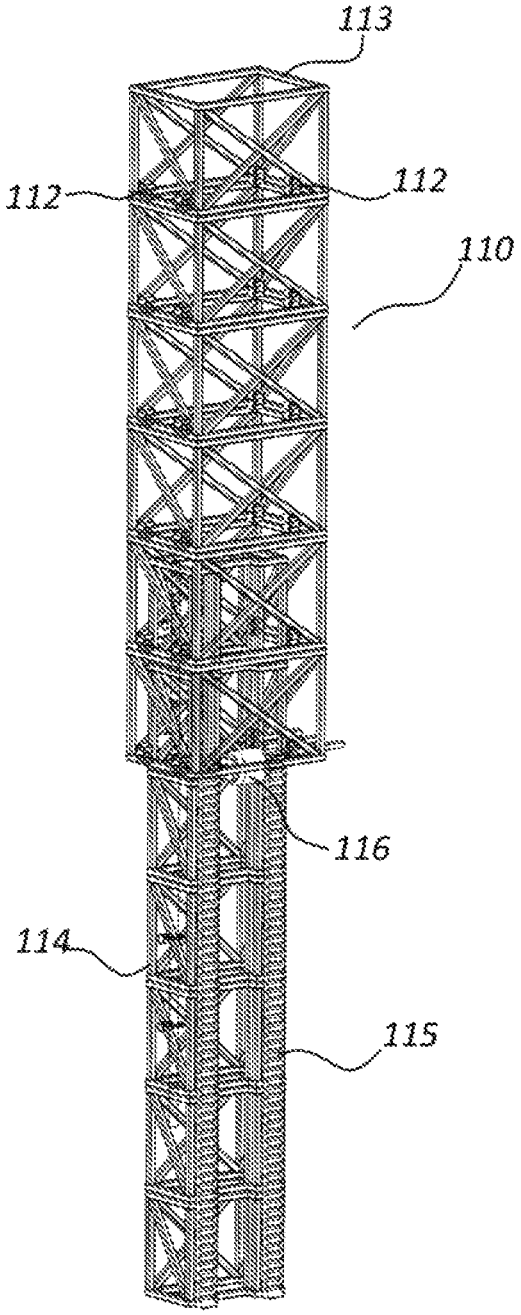
FIG. 6 is a front perspective isolated view of the movable columns when mounted.

The movable columns (110), on the other hand, provides opening/closing of the scaffold (100) as follows: The scaffold modules (130) are loaded to the outer carrier column (111). In other words, the entire load is carried by the outer carrier columns (111). However, the vertical descending and ascending movement is provided by the inner movable columns (114) for the outer carrier columns (111). Therefore, all the load of the system is on the inner movable column (114). The inner movable column (114) is located in the space (113) of the outer carrier column (111), and in that space (113) the system is provided with movement. The outer carrier column (111) is provided with vertical linear movement in the s/s1 directions through the control rod (115) fixed on the inner movable column (114), and the circular gear (117) driven by the motor on the outer carrier column (111). (See FIG. 6). Centering elements (112) are located in the space (113) of the outer carrier column (111) in order to provide that the movement is rigid and properly linear. The centering elements (112) have rollers (127) for making the movable columns (110) to proceed more easily.

Figure 2:
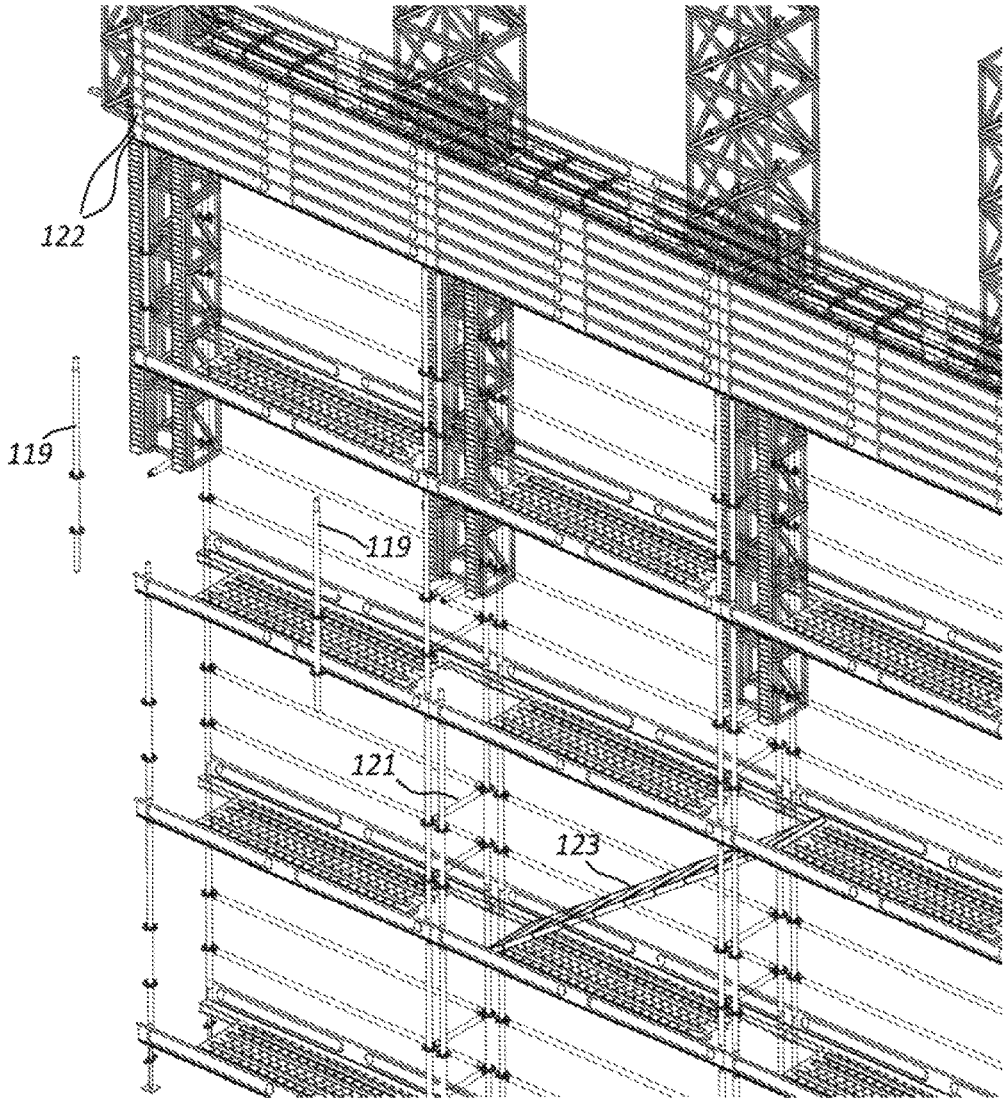
FIG. 2 is a perspective close up view of the movable structure for installing the scaffold carrier plates with the rods.
Figure 3:
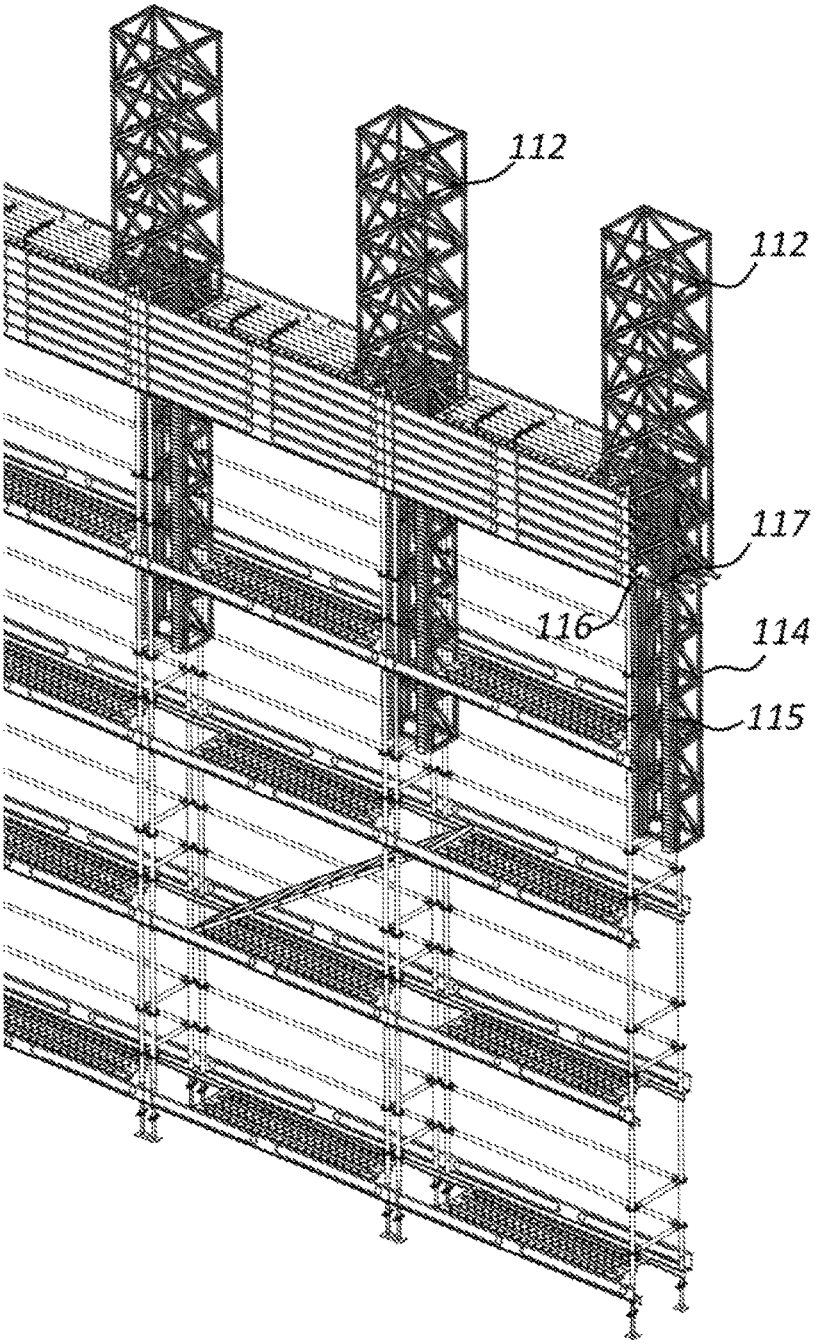
FIG. 3 is a perspective close up view of the scaffold carrier plates some of which are opened, and some of which are folded and not opened.
Figure 4:
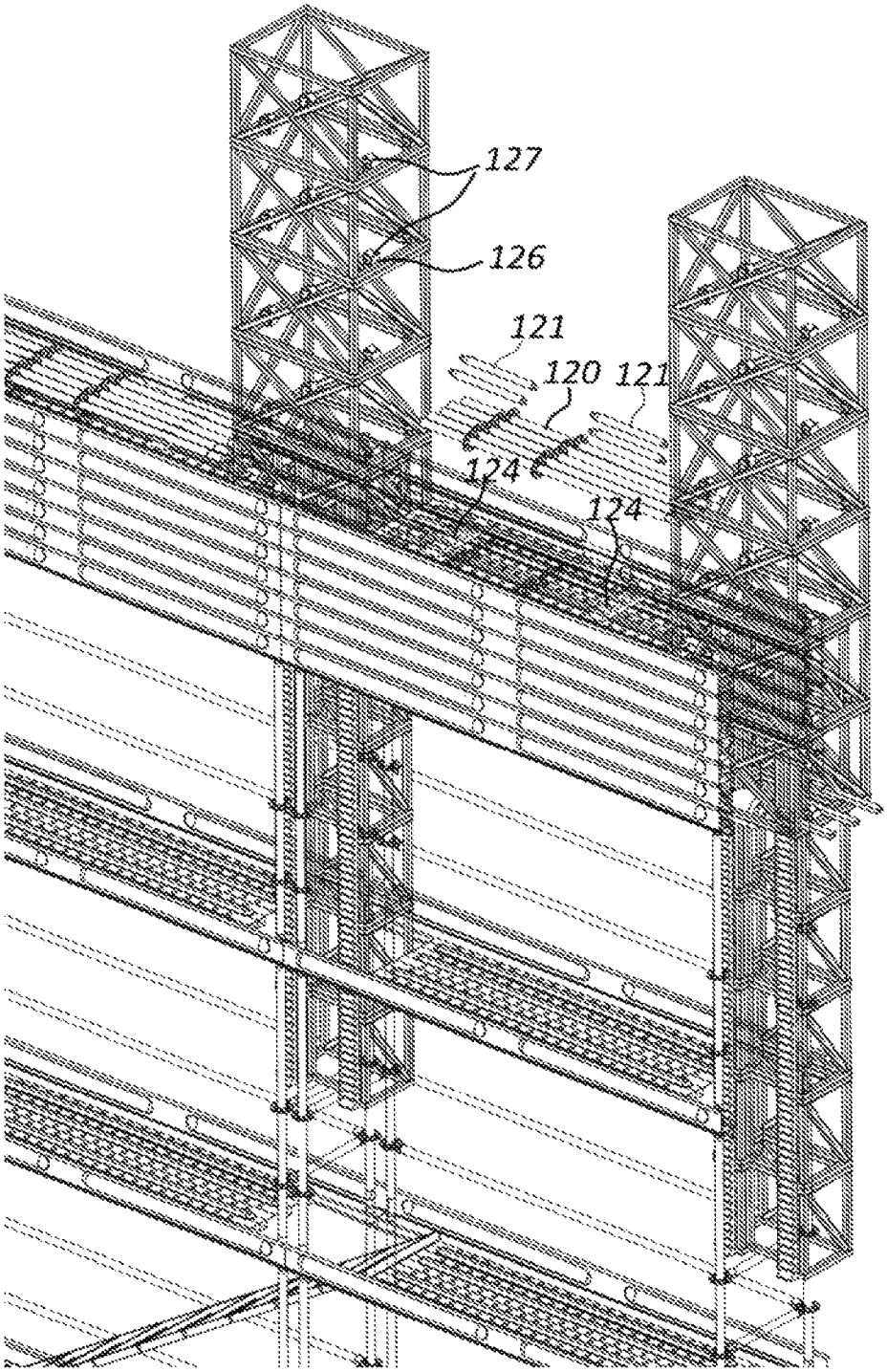
FIG. 4 is a perspective close up view of the rods located on the scaffold carrier plates when folded.
Figure 7:
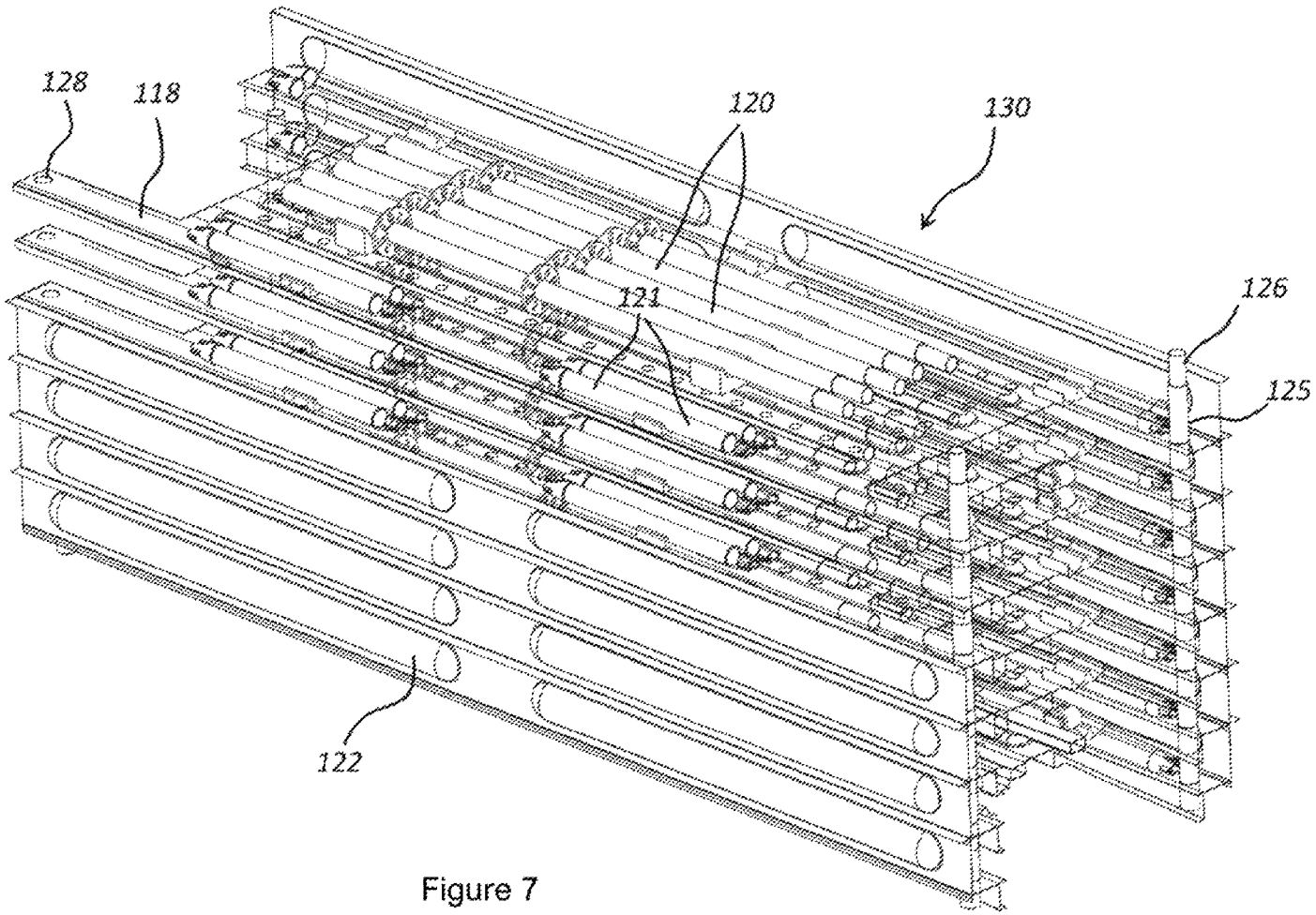
FIG. 7 is a general perspective view of the scaffold carrier plates in switched-off position when their front covers have been partly raised off.

In FIG. 7, on the other hand, the scaffold module (130) is shown individually. The module layers (131) are located in superimposed positions. Guide elements (125) are bedded or centered between the module layers (131). The guide elements (125) located in the guide spaces (128) of the carrier plate (118) at the same time serve as bedding elements for the vertical carrier rods (119) between the module layers (131). The distance (A) is formed by means of the guide elements (125) and the vertical carrier rods (119). By using the rod locating elements (124), the horizontal and vertical rods (119, 120, 121) can be located on the carrier plate (118). (See FIG. 4). After the distance (A) has been formed, the horizontal and vertical rods (119, 120, 121) are attached to the guide elements (125) in a click-fit manner by the staff (See FIG. 2). The superimposition of the module layers (131) forming the scaffold module (130) is provided by the guide spaces (128) created on the carrier plates (118) and the guide elements (125) located within these spaces (128). The upper ends of the guide elements (125) have guide step sections (126) respectively, and the bottom ends of the guide elements (125) are fitted to the guide step sections (126) respectively, and thereby superimposed and closed. As the modular layers (131) are opened, vertical carrier rods (119) are fixed between the guide elements (125).

The carrier plates (118) have one-piece structures. Preferably it is possible to produce them with modular multiple-piece structures. The vertical carrier rods (119) form a skeleton structure by being squeezed between the carrier plates (118). As the carrier plate (118) has a platform and a walking line, the walking path platform on any floor of the scaffold (100) according to the present invention cannot be separately removed. In order to remove a platform on an intermediate floor, all the system should be uninstalled from top to down.

There are vertical and horizontal rods (119, 120, 121) in order to form a distance (A) between the module layers (131). These rods (119, 120, 121) are quickly installed by the staff, and thus a module layer (131) is obtained with a distance (A) for working. The passage from one module layer (131) to the other is provided by ladders (123). In order to move the movable columns (110), a motor serving as a drive unit (116) is used. However, instead of a motor, preferably manual use is possible. Also the movable columns (110) can be provided with the vertical linear movement through lifters with hydraulic or pneumatic systems.

The invention claimed is:

1. An automatic scaffold apparatus for reaching buildings during construction, repair, dyeing, coating and maintenance processes, the automatic scaffolding apparatus comprising:

a scaffold module having a plurality of module layers which are superimposed layers;

a plurality of movable columns adapted to extend the superimposed module layers by a drive unit so as to generate a distance between two superimposed module layers facing one another, wherein the distance is of a height of approximately two meters suitable for allowing a person to stand between the two superimposed module layers facing one another, said plurality of movable columns respectively comprising:

an outer carrier column adapted to carry said scaffold module upward with a movement of the outer carrier column generated by the drive unit; and an inner movable column that is located inside a space within said outer carrier column and movably linked to said outer carrier via a control rod of the drive unit;

a plurality of vertical and horizontal rods positioned on a plurality of carrier plates; and the plurality of carrier plates each having guide elements wherein the guide elements fix respective vertical rods to respective adjacent carrier plates separated by the drive unit.

2. The automatic scaffold apparatus of claim 1, wherein each carrier plate has a one-piece structure.

3. The automatic scaffold apparatus of claim 1, wherein each carrier plate has a modular structure.

4. The automatic scaffold apparatus of claim 1, wherein the drive unit comprises a motor.

5. The automatic scaffold apparatus of claim 1, wherein the drive unit has a piston with a hydraulic or pneumatic system.

6. The automatic scaffold apparatus of claim 1, wherein the drive unit has a circular gear rotatably connected to the control rod.

7. The automatic scaffold apparatus of claim 1, further comprising:

a plurality of centering elements having rollers that provide a linear movement to the inner movable column within the outer carrier column.

8. The automatic scaffold apparatus of claim 1, wherein each of said guide elements has a step section thereon.

9. The automatic scaffold apparatus of claim 1, wherein each of said carrier plates has guide spaces for positioning the guide elements.

10. The automatic scaffold apparatus of claim 1, further comprising:

a plurality of rod locating elements fixing the vertical and horizontal rods onto carrier elements.

11. The automatic scaffold apparatus of claim 1, further comprising:

a plurality of front covers fixed on the superimposed module layers of said scaffold module.

12. The automatic scaffold apparatus of claim 1, further comprising:

a plurality of legs located under the vertical rods and adapted to be fixed to the floor.

13. The automatic scaffold apparatus of claim 1, further comprising:

a remote control cooperative with the drive unit so as to control the drive unit.

* * * * *